US008807826B2

(12) United States Patent
Georg et al.

(10) Patent No.: US 8,807,826 B2
(45) Date of Patent: Aug. 19, 2014

(54) STATIC MIXING DEVICE FOR FLOWABLE SUBSTANCES

(75) Inventors: Alain Georg, Hettlingen (CH); Günther Schwald, Oberkotzau (DE); Daniel Altenburger, Winterthur (CH); Tobias Vögeli, Winterthur (CH); Silvano Andreoli, Winterthur (CH)

(73) Assignee: Fluitec Invest AG, Hettlingen (CH)

( * ) Notice: Subject to any disclaimer, the term of this patent is extended or adjusted under 35 U.S.C. 154(b) by 971 days.

(21) Appl. No.: 12/855,295

(22) Filed: Aug. 12, 2010

(65) Prior Publication Data

US 2011/0080801 A1 Apr. 7, 2011

(30) Foreign Application Priority Data

Aug. 12, 2009 (EP) ..... 09405136

(51) Int. Cl.
*B01F 5/06* (2006.01)
*B01F 3/10* (2006.01)

(52) U.S. Cl.
CPC ..... *B01F 3/10* (2013.01); *B01F 2215/0422* (2013.01); *B01F 5/0619* (2013.01); *B01F 2215/0431* (2013.01); *B01F 2215/0049* (2013.01)
USPC ..... 366/337

(58) Field of Classification Search
CPC ..... B01F 5/0618; B01F 5/0619
USPC ..... 366/337
See application file for complete search history.

(56) References Cited

U.S. PATENT DOCUMENTS

| | | | | |
|---|---|---|---|---|
| 4,201,482 | A | 5/1980 | Imhauser et al. | |
| 7,077,561 | B2 * | 7/2006 | Streiff et al. | 366/337 |
| 7,198,400 | B2 | 4/2007 | Unterlander et al. | |
| 7,390,121 | B2 | 6/2008 | Jaehn et al. | |
| 2002/0118598 | A1 * | 8/2002 | Schuchardt | 366/337 |
| 2004/0125691 | A1 * | 7/2004 | Streiff et al. | 366/337 |

FOREIGN PATENT DOCUMENTS

| | | | |
|---|---|---|---|
| CH | 642564 | A5 | 4/1984 |
| CH | 693560 | A5 | 10/2003 |
| DE | 2822096 | A1 | 11/1979 |
| DE | 4428813 | A1 | 2/1996 |
| DE | 19813600 | A1 | 9/1999 |
| FR | 2807336 | A1 | 10/2001 |

* cited by examiner

*Primary Examiner* — David Sorkin
(74) *Attorney, Agent, or Firm* — Browdy and Neimark, PLLC

(57) ABSTRACT

A static mixing device has a flow duct (10) with at least one mixing element (12) arranged in the flow duct (10). Each mixing element (12) has a multiplicity of webs (14A, 14B) which are arranged in a crossed fashion and which enclose an angle (α) of greater than 0° with the longitudinal axis (x) of the flow duct (10). The webs (14A, 14B) are of waisted design between adjacent crossing points (16), and in the middle between adjacent crossing points (16) the webs (14A, 14B) have their smallest width (b) and mutually adjacent webs (14A, 14B) have their greatest intermediate spacing (a). Those webs (14A, 14B) which are adjacent to the inner wall of the flow duct (10) have, between face-side abutting edges (22), a recess which corresponds to the waisting of the webs (14A, 14B) so as to form a greatest wall spacing (c) in the middle between the face-side abutting edges (22), with the sum, measured over the diameter of the mixing element (12), of the smallest widths (b) of the webs (14A, 14B) amounting to at least 35% of the diameter of the mixing element (12).

10 Claims, 2 Drawing Sheets

STATIC MIXING DEVICE FOR FLOWABLE SUBSTANCES

TECHNICAL FIELD

The present invention relates to a static mixing device, having a tubular flow duct which has a longitudinal axis and an inner diameter, having a mixing element which is arranged in the flow duct and which has a length and a diameter substantially corresponding to the inner diameter of the flow duct, with each mixing element having a multiplicity of webs which are arranged in a crossed fashion and which enclose an angle of greater than 0° with the longitudinal axis of the flow duct, with the webs being arranged in two intersecting plane groups which have a multiplicity of planes arranged parallel to one another and separated from one another by an equal spacing, and with mutually adjacent webs having an intermediate spacing in a projection of the two plane groups onto a projection plane situated perpendicular to the longitudinal axis of the flow duct.

PRIOR ART

Static mixers are used nowadays in all fields of chemical engineering. A characteristic of static mixers is that only the liquids or gases to be mixed are moved. In contrast to dynamic mixing systems, stirring does not take place, but rather pumps, fans or compressors continuously convey the media to be mixed to the mixing tube equipped with the mixing elements. Static mixers can generally be used in the following fields of application:

- mixing pumpable liquids
- dispersing and emulsifying components which are insoluble in one another
- mixing reactive liquids
- mixing and homogenizing plastic melts
- generating contact between gas and liquid
- mixing gases
- heat exchange of viscous substances A static mixer which is known from U.S. Pat. No. 3,286,992 A and which is referred to as a helical mixer has helically curved, blade-like, alternately left-handed and right-handed plates or mixing elements which, with crossing face edges arranged in series, split up the substances to be mixed upon entry into each element. The flow duct maintains the same shape and cross section in each of the elements. The helical mixer serves in particular for mixing in the turbulent range. In the laminar range, the helical mixer can be used only to a limited extent on account of its moderate mixing power.

A specific family of static mixers are the so-called X mixers. These are composed of crossed webs or plates. An X mixer known from AT 330 135 B has, in a tube, at least one mixing insert in the form of a plate pair which has webs and slots. Here, in each case the webs of one plate extend in a crossing fashion through the slots of the other plate. The plates are arranged so as to be inclined relative to one another and relative to the axis of the tube. As a result of the inclination of the plates, the supplied flow of substances to be mixed is split up by the webs into partial flows in a chronologically and locally offset fashion. In said known mixer, the web extensions form significant dead zones which unnecessarily increase the residence time and can damage critical liquids. Furthermore, the plates must be positioned with innumerable weld seams, which can lead to increased corrosion. The assembly of the plates is very time-consuming and therefore expensive. Said known device serves in particular for mixing in the laminar range. In the turbulent range, said device can be used only to a limited extent on account of its high pressure loss.

The development of the mixer according to CH 642 564 A5 in 1979 represented an improvement in static mixing technology for laminarly flowing media. Since then said mixer has proven itself and it is successfully used in a very wide field of applications, usually with highly viscous media. Said mixer is illustrated in FIG. 1 of CH 642 564 A5 as a mixer with 8 web tiers, also referred to as an 8-web mixer, having an L/D ratio of 1. The mixer has a very high pressure loss.

The geometry known as the CSE-X mixer is described in CH 693 560 A5. Said patent presents a device for static mixing comprising a tubular housing with at least one mixing insert arranged therein in the form of a plate which has webs and slots and which is bent. It is preferable for the plates to have projections at the web edges, and to have elliptical circumferential shapes. Two bent plates, in each case the webs of one plate extending through the slots of the other plate, are fastened to the projections. The mixing inserts may be positioned in series in the tubular housing, with it being possible for the mixing inserts to be in direct contact or to have spacings between the inserts. The device can provide excellent mixing results in all flow ranges with this simple geometry. The mixing quality is determined only by the number of mixing inserts and their installation position. The mixing insert was marketed in particular in 4-web, 6-web and 8-web construction and likewise has a high pressure loss which increases with an increasing number of webs.

EP 0 154 013 A1 presents a mixing device for machines which process plastic melts. The mixing element has crossing webs whose end pieces extend through the openings of the tube or of a sleeve. The webs have free intermediate spaces between the crossing points and significantly reduce the pressure loss. The stable welded construction can distort considerably in the event of large temperature differences, which can lead to jamming of the sleeve in the tube.

WO 2009/000642 A1 presents a mixing device of the type specified in the introduction, in which—as in EP 0 154 013 A1—the webs have free intermediate spaces between the crossing points. The 5-web mixer illustrated in FIG. 3 of WO 2009/000642 A1 has an L/D ratio of 1. The pressure loss is considerably reduced with this geometry. However, the construction is mechanically very weak and can scarcely be welded by an expert. Soldered versions are very complex and generally can scarcely be formed without gaps.

The trade publication Pharma and Food 2/2004 describes Mikromakro® technology with static mixers. Micro-macro mixing is to be understood to mean the targeted use of static mixers of different geometries and nominal widths. It is basically necessary firstly to obtain a uniform preliminary distribution in the macro-mixer, and the best possible fine distribution is thereafter obtained in the micro-mixer. As a basis, use is typically made of CSE-X mixers.

Summarizing the testing of X-mixers in recent years, in each case the following possible parameters have been varied:

- the L/D ratio of a mixing element
- the number of web tiers
- the thickness of the webs
- the angular position of the webs
- the shape of the webs
- the width of the webs The tests in CH 642 564 A5 show that the number of web tiers directly influences lamination and therefore the mixing quality. The greater the number of web tiers used, the more layers are generated, which has a positive effect on the mixing quality. However, with increasing number of web tiers, the pressure loss also increases. According to CH 642 564 A5, an ideal geometry has six or eight web tiers and an L/D ratio of 0.75 to 1.5.

Further tests with geometries according to CH 642 564 A5 have yielded that, with a greater number of web tiers, considerably higher pressure losses are generated with only slightly improved mixing quality. Accordingly, static mixing elements with four web tiers, which preferably have an L/D ratio of 0.5 to 1.0, are to be found on the market. In fact, the 4-web mixer exhibits excellent characteristics, but also has a high pressure loss.

With the geometry known from WO 2009/000642 A1, in which the webs have free intermediate spaces between the crossing points, it is duly possible to considerably reduce the pressure loss of the above-described 4-web mixer, but the mixing quality decreases. With the arrangement of intermediate spaces, however, it is possible to obtain a good mixing action with an acceptable pressure drop.

PRESENTATION OF THE INVENTION

The invention is based on the object of providing a static mixing device of the type mentioned in the introduction which has a further improved mixing action without a significant increase in a pressure drop, which static mixing device does not have the abovementioned disadvantages of mixers according to the prior art. The mixing device should preferably be able to be used in the laminar flow range and should ensure substantially complete mixing. The mixing elements should be able to be produced simply and cost-effectively, should have a considerably reduced pressure loss and should be able to be assembled in a mechanically stable fashion to form mixer rods. The mixing elements should be able to be positioned, in the shortest possible structural shapes and also in long structural shapes, in the flow duct. The flow duct should be able to have a round, rectangular or square cross section.

The object is achieved according to the invention in that the webs are of waisted design between adjacent crossing points, and in the middle between adjacent crossing points the webs have their smallest width and mutually adjacent webs have their greatest intermediate spacing, and those webs which are adjacent to the inner wall of the flow duct have, between face-side abutting edges, a recess which corresponds to the waisting of the webs and which has the smallest width so as to form a greatest wall spacing in the middle between the face-side abutting edges, with the sum, measured over the diameter of the mixing element, of the smallest widths of the webs amounting to at least 35% of the diameter of the mixing element.

Preferred embodiments of the static mixing device according to the invention have one or more of the features specified below:

- All the webs enclose an angle of 45° with the longitudinal axis of the flow duct.
- All the webs have the same smallest width.
- All the mutually adjacent webs have the same greatest intermediate spacing.
- The smallest width of the webs amounts to 50% of their width at the crossing points of the webs.
- The smallest width of the webs is equal to the greatest intermediate spacing of adjacent webs.
- The greatest wall spacing amounts to 50% of the smallest width of the webs and 50% of the greatest intermediate spacing of adjacent webs.
- The mixing element has four web tiers.
- Successive mixing elements in relation to the longitudinal axis of the flow duct are arranged so as to be rotated relative to one another by 90°.
- Successive mixing elements are spaced apart from one another.

The static mixing device according to the present invention is suitable in particular for mixing media, with at least one of said media being a flowable, laminarly flowing medium, in particular a polymer melt or some other highly viscous fluid.

To be able to compare the efficiency of static mixers, it is necessary for a comparison to consider the energy requirement and the mixing quality. The energy requirement of the static mixer is directly proportional to the pressure loss. In the laminar flow range, the following equation applies to a static mixer in a round hollow body:

$$\Delta p_L = 32 \cdot z \cdot \eta \cdot w \cdot \frac{L}{D^2}$$

The variable z is referred to as the pressure loss multiple and represents the ratio of the pressure loss for a static mixer in a round hollow body to the empty tube. η denotes the dynamic viscosity, w denotes the flow speed, L denotes the length and D denotes the diameter. The z factor is a laminar resistance factor which is common in static mixing technology and is often taken into consideration for the comparison of static mixers.

For the comparison of the mixing power, use is generally made of the relative standard deviation $S/S_0$. With regard to said known measure of mixing quality, it should be noted that measurement results can be detected only by the same measurement analysis method. The literature discloses measurements by means of conductivity measurement, decolourization, laser-induced fluorescence (LIF) or by means of photometric analysis FIP (Fluitec Image Processing). One may therefore only compare measurements obtained using the same method, since otherwise considerable deviations are generated.

To be able to compare the mixing power of different static mixer geometries, use is conventionally made of the mixing intensity M, determined as follows:

$$M = \frac{\Delta p_L \cdot D}{\eta \cdot w} = 32 \cdot z \cdot \frac{L}{D}, \text{ where } \frac{L}{D} = f\left(\frac{S}{S_0}\right).$$

The mixing intensity enables the comparison of static mixers of uniform diameter D.

The comparison of the static mixer geometries is carried out for a relative standard deviation $S/S_0$ of 0.05, which in the photometric analysis FIP corresponds to a practically homogeneous mixture.

Table 1 presents a comparison of the mixing intensities of a mixer according to the invention and of four mixers according to the prior art. The mixing qualities of the following mixer types were compared with one another:

I Helical mixer

II CSE-X mixer (4-web mixer), for example according to CH 693 560 A5

III X mixer (8-web mixer), for example according to CH 642 564 A5

IV X mixer (6-web mixer, crossed webs laterally spaced apart), according to WO 2009/000642 A1

V X mixer (4-web mixer, crossed webs laterally spaced apart), according to the present invention.

TABLE 1 mixing intensities of different mixer types

| Mixer type | No. of web tiers | L/D | z | Angle α | $S/S_0$ | M | % |
|---|---|---|---|---|---|---|---|
| I | 1 | 25 | 6.5 | — | 0.05 | 5200 | 100 |
| II | 4 | 11 | 23 | 45° | 0.05 | 8096 | 166 |
| III | 8 | 8 | 37 | 45° | 0.05 | 9472 | 182 |
| IV | 6 | 10 | 18 | 45° | 0.05 | 5760 | 111 |
| V | 4 | 10 | 15 | 45° | 0.05 | 4800 | 92 |

The L/D ratio for a relative standard deviation $S/S_0$ of 0.05 yields, for the individual mixer types, the diagram illustrated in FIG. 5.

In the present comparative tests, the mixing intensity M which is used as a measure of mixing quality is compared to the mixing intensity, set as a basis of 100%, of the helical mixer which until now has been the mixer with the lowest mixing intensity, the disadvantage of which is however a high L/D ratio of 25, and which accordingly requires a large structural length. This applies in the case of two media to be mixed which have a viscosity ratio of 1:1.

The test results in table 1 clearly show the positive influence of free intermediate spaces between laterally adjacent webs in the projection plane perpendicular to the mixer longitudinal axis on the mixing quality in mixer type IV and mixer type V, with the arrangement of two additional intermediate spaces between the webs close to the wall and the inner wall of the flow duct in the mixer type V according to the invention leading to a further significant reduction in mixing intensity, which is even lower than the mixing intensity of the helical mixer. This appears to contradict the experience that intermediate spaces close to the wall lead to a wall effect. By providing the webs with a waisted design, however, a wall effect can be prevented.

Strength calculations have also shown that a mixing element can withstand a higher pressure difference as a result of the waisting of the webs than a mixing element with non-waisted webs. As a result of the waisting, the mixing element is more flexible and the loads are better distributed over the webs.

BRIEF DESCRIPTION OF THE DRAWINGS

Further advantages, features and details of the invention will emerge from the following description of preferred exemplary embodiments and on the basis of the drawing, which serves merely for explanation and should not be interpreted as restrictive. In the drawing, in each case schematically.

DESCRIPTION OF PREFERRED EMBODIMENTS

Figure 1:
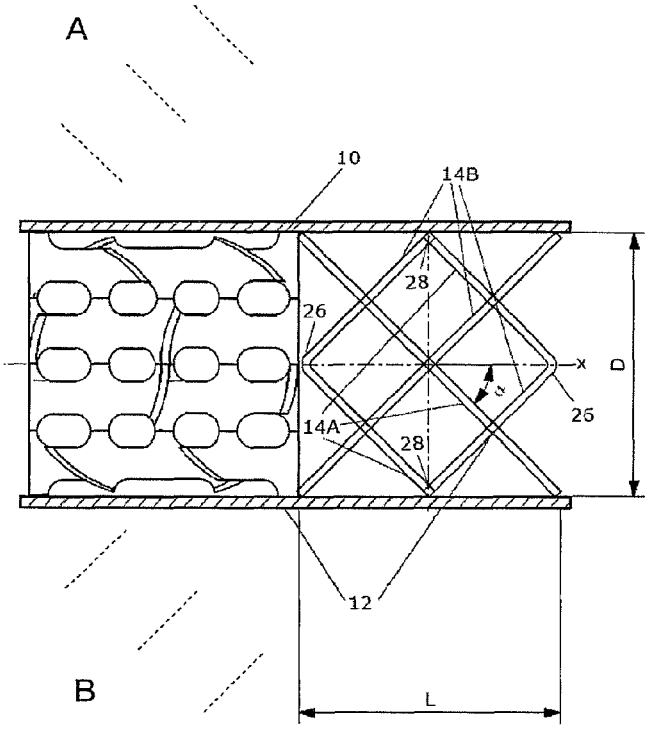
FIG. 1 shows a side view of a part of a flow duct with two mixing elements adjoining one another.

A tubular flow duct 10 shown in FIG. 1, which flow duct 10 has a longitudinal axis x and an inner diameter D, has two identical mixing elements 12 which adjoin one another, have a length L and have an envelope diameter substantially corresponding to the inner diameter D of the flow duct 10. The two mixing elements 12 are arranged rotated relative to one another about the longitudinal axis x of the flow duct 10 by an angle of 90°. The mixing element 12 is composed of a multiplicity of crossed webs 14A, 14B. The webs 14A, 14B lie in planes which are arranged parallel to one another and which are separated from one another by an equal spacing, which planes form two crossed plane groups A, B. The two plane groups A, B enclose an angle α of 45° with the longitudinal axis x of the flow duct and an angle of 90° with one another. The mixing element 12 illustrated by way of example in the drawing has four web tiers with in each case two alternately crossing webs 14A, 14B, and therefore corresponds to a 4-web mixer.

Figure 2:
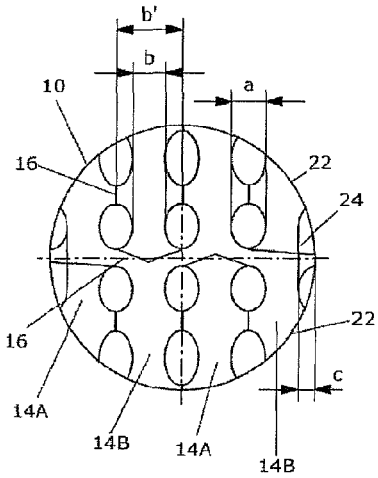
FIG. 2 shows the view of a mixing element in the flow duct of FIG. 1, viewed in the direction of the longitudinal axis of the flow duct.

From the projection, illustrated in FIG. 2, of the two web groups A, B onto a first projection plane situated perpendicular to the longitudinal axis x of the flow duct 10, it can be seen that the webs 14A, 14B are of symmetrically waisted design between crossing points 16 and all have an equal smallest width b in the middle between adjacent crossing points 16, which smallest width b amounts to 50% of the width b' at the crossing points 16. All the webs 14A, 14B are waisted in the same way and have the same dimensions. In the present case, the greatest intermediate spacing a of adjacent webs 14A, 14B corresponds to the smallest web width b.

All the webs 14A, 14B extend within the mixing element over in each case their maximum possible length delimited by the end sides of the mixing element 12 and by the inner wall of the flow duct 10, with the contour of the webs 14A, 14B close to the wall being only partially adapted, so as to ensure a wall spacing to the circular cross section of the flow duct 10, such that in the case of the webs 14A, 14B close to the wall—like the other webs—only face-side end regions 22 adjoin the inner wall of the flow duct 10 with a small amount of play. The webs 14A, 14B adjoining the inner wall of the flow duct 10 are provided, on the side pointing toward the inner wall, with a recess 24 which extends between the face-side end regions or abutting edges 22 with the inner wall of the flow duct 10, and corresponding to the waisting of the webs, have a greatest wall spacing c which in the present case amounts to 50% of the greatest intermediate spacing a of adjacent webs 14A, 14B.

Figure 4:
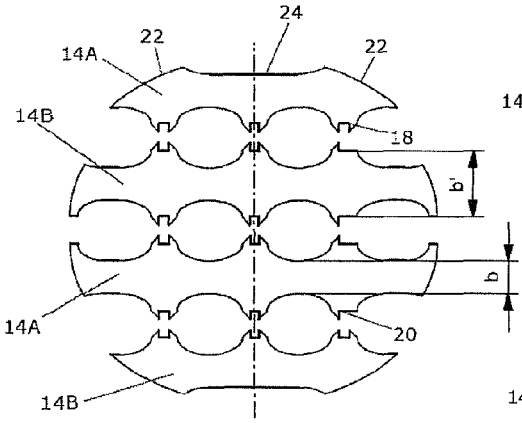
FIG. 4 shows the plan view of four webs to be connected to two web plates of FIG. 3 after bending to form a mixing element.
Figure 3:
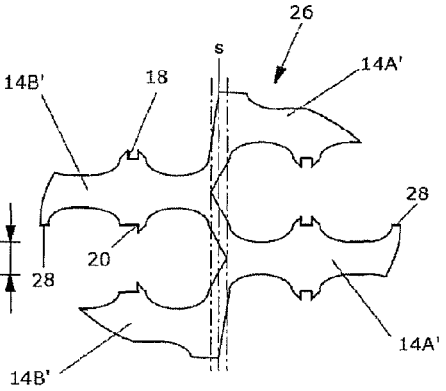
FIG. 3 shows the plan view of a web plate of a mixing element having four web parts, before bending.
Figure 5:
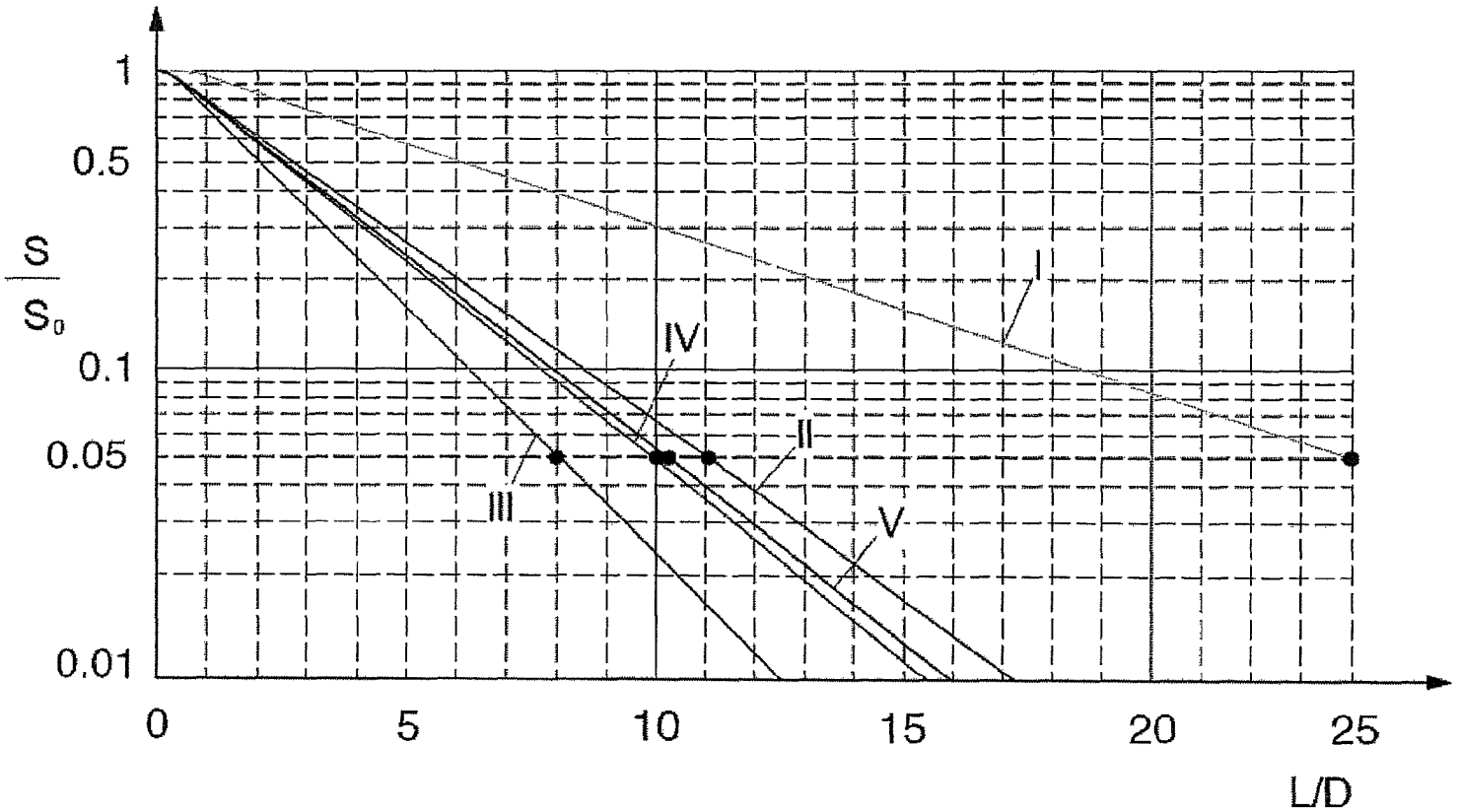
FIG. 5 shows a diagram for determining the L/D ratio of different mixers for the same relative standard deviation $S/S_0$.

As can be seen from FIGS. 3 and 4, the webs 14A, 14B have, at each provided crossing point 16, a notch 18 or an undercut which corresponds to the notch depth of the notch 18 and produces a projection 20.

The mixing element 12 is assembled in a simple manner from two web plates 26 shown in FIG. 3 and four alternately arranged half-webs 14A', 14B', corresponding to the four webs 14A, 14B illustrated in FIG. 4, and the four webs 14A, 14B illustrated in FIG. 4. Here, two web plates 26 are bent by an angle of 90° about an axis s, and are connected to one another by welding in the manner shown in FIG. 1 via ends 28 of the two central web halves 14A', 14B'. The four webs 14A, 14B illustrated in FIG. 4 are plugged by means of the notches 18 and projections 20 at the crossing points 16 onto the bent web plates 24 which are welded to one another, and said webs 14A, 14B are partially welded at the crossing points 16.

LIST OF REFERENCE SYMBOLS

10 Flow duct
12 Mixing element
14A, 14B Webs
16 Crossing point 14A-14B

18 Notch on 14A, 14B
20 Projection on 14A, 14B
22 Face-side end regions
24 Recesses
26 Web plates
28 Ends of 14A, 14B
A Plane group of 14A
B Plane group of 14B
D Diameter of 10
L Length of 12
x Longitudinal axis of 10
a Greatest intermediate spacing 14A-14B
b/b' Smallest/greatest web width of 14A, 14B
c Greatest wall spacing of 14A, 14B

The invention claimed is:

1. Static mixing device, having a tubular flow duct which has a longitudinal axis and an inner diameter, having at least one mixing element which is arranged in the flow duct and which has a length and a diameter corresponding to the inner diameter of the flow duct, with the at least one mixing element having a multiplicity of webs which are arranged in a crossed fashion and which enclose an angle of greater than 0° with the longitudinal axis of the flow duct, with the webs being arranged in two intersecting plane groups which have a multiplicity of planes arranged parallel to one another and separated from one another by an equal spacing, and with mutually adjacent webs having an intermediate spacing in a projection of the two plane groups onto a projection plane situated perpendicular to the longitudinal axis of the flow duct, wherein the webs are of waisted design between adjacent crossing points, and in the middle between adjacent crossing points the webs have their smallest width and mutually adjacent webs have their greatest intermediate spacing, and those webs which are adjacent to the inner wall of the flow duct have, between face-side abutting edges, a recess which corresponds to the waisting of the webs and which has the smallest width so as to form a greatest wall spacing in the middle between the face-side abutting edges, with the sum, measured over the diameter of the at least one mixing element, of the smallest widths of the webs amounting to at least 35% of the diameter of the at least one mixing element.

2. Static mixing device according to claim 1, wherein all the webs enclose an angle of 45° with the longitudinal axis of the flow duct.

3. Static mixing device according to claim 1, wherein all the webs have the same smallest width.

4. Static mixing device according to claim 1, wherein all the mutually adjacent webs have the same greatest intermediate spacing.

5. Static mixing device according to claim 1, wherein the smallest width of the webs amounts to 50% of their width at the crossing points of the webs.

6. Static mixing device according to claim 1, wherein the smallest width of the webs is equal to the greatest intermediate spacing of adjacent webs.

7. Static mixing device according to claim 1, wherein the greatest wall spacing amounts to 50% of the smallest width of the webs and 50% of the greatest intermediate spacing of adjacent webs.

8. Static mixing device according to claim 1, wherein the at least one mixing element has four web tiers.

9. Static mixing device according to claim 1, further comprising a successive element in addition to the at least one mixing element, and wherein the successive mixing element in relation to the longitudinal axis of the flow duct is arranged so as to be rotated relative to the at least one mixing element by 90°.

10. Static mixing device according to claim 1, further comprising a successive element in addition to the at least one mixing element, and wherein the successive mixing element is spaced apart from the at least one mixing element.

* * * * *